United States Patent [19]

Hoshino

[11] Patent Number: 4,640,175

[45] Date of Patent: Feb. 3, 1987

[54] SUPPORT LEG FOR BASS DRUM

[75] Inventor: Yoshihiro Hoshino, Nagoya, Japan

[73] Assignee: Hoshino Gakki Co., Ltd., Japan

[21] Appl. No.: 818,550

[22] Filed: Jan. 13, 1986

[30] Foreign Application Priority Data

Feb. 6, 1985 [JP] Japan ..... 60-015438

[51] Int. Cl.[4] ..... G10G 5/00

[52] U.S. Cl. ..... 84/421; 248/285; 248/286; 403/59

[58] Field of Search ..... 84/411–421; 248/285, 286; 403/59, 60

[56] References Cited

U.S. PATENT DOCUMENTS

| | | | |
|---|---|---|---|
| 369,971 | 9/1887 | Stillman | 248/286 X |
| 3,541,914 | 11/1970 | Thompson | 84/421 |
| 3,945,291 | 3/1976 | Zickos | 84/421 |

FOREIGN PATENT DOCUMENTS

| | | |
|---|---|---|
| 56-5119 | 2/1981 | Japan . |
| 58-9271 | 2/1983 | Japan . |
| 58-37101 | 8/1983 | Japan . |
| 59-21427 | 6/1984 | Japan . |

*Primary Examiner*—Lawrence R. Franklin

*Attorney, Agent, or Firm*—Ostrolenk, Faber, Gerb & Soffen

[57] ABSTRACT

A support leg for a bass drum is provided. A circular surface is provided on the base member attached to the drum which has a positioning member thereon. A shaft means projects from the center of the circular surface, one end of which is attached to the base member. Inner and outer block members surround the shaft and have mutually facing surfaces for holding the leg member. The inner block has a mating circular surface which slidably mates with the circular surface of the base member and another positioning member which mates with and engages the positioning member. A means, is provided on other end of the shaft, for releasably engaging the outer block and urging the blocks together. A first spring means between the blocks has a spring pressure for urging the blocks apart. A member connects the blocks for setting and holding a predetermined gap between the blocks. A second spring means is provided between the inner block and base member and has a spring pressure for urging the inner block and base apart. The spring pressure of the second spring means is smaller than the spring pressure of the first spring means. When the outer block is released, the gap between the inner and outer blocks widens to the predetermined gap by the coaction of the first spring means between the inner and outer blocks loosening the leg member therebetween. A gap between the base and inner block is subsequently created by the coaction of the second spring means between the inner block and base to permit rotation of the leg holding member on the base and disengagement of the first and second positioning members.

6 Claims, 6 Drawing Figures

SUPPORT LEG FOR BASS DRUM

BACKGROUND OF THE INVENTION

1. Field of the Invention

This invention relates to a support leg for a bass drum, and in particular to the structure of a leg which holds the support leg in rotary and freely expandable and contractable manner.

2. Description of the Prior Art

Japanese Official Gazettes, Utility Model Publications Sho 56-5119, Sho 58-9271 and Sho 58-37101, describe a support leg of a bass drum which is held in a freely rotatable manner relative to the drum trunk part for the purpose of accomodating the support leg of a bass drum, in such a way as not to be an obstruction when it is being transported. The support leg may be provided with a certain incline permitting the leg to be installed either on the right side or left side of the drum. In such known structures, the leg is often made either to extend or contract for the purpose of adjusting the length thereof at the same time.

OBJECTS AND SUMMARY OF THE INVENTION

It is an object of this invention to provide a structure for a leg to bass drum, in which, the support leg of the bass drum is held in such a manner as to be freely rotatable and freely slidable.

It is a further object of this invention to provide a support leg of simple construction wherein the rotation and the contraction of the leg can be accomplished in a single maneuver by the user.

It is still a further object of this invention to provide a support leg for a bass drum in which the rotation and contraction of the leg can be carried out by maneuvering a single tightening member.

All of the foregoing objects, as well as others, are accomplished by a support leg for a bass drum having a supporting bass drum body, the support leg comprising:

an elongated leg member;

a base member having an attachment means for attaching the base member to the drum body and a circular surface on the base member having a first positioning member thereon;

a shaft means projecting from the center of the circular surface, one end of which is attached to the base member;

a leg holding member comprising:

inner and outer block members surrounding the shaft having mutually facing surfaces for holding the leg member, the inner block having a mating circular surface which slidably mates with the circular surface of the base member and a second positioning member which mates with and engages the first positioning member;

means, mounted to the other end of the shaft, for releasably engaging the outer block and urging the blocks together;

a first spring means between the blocks surrounding the shaft and having a spring pressure for urging the blocks apart;

a member connecting the blocks for setting and holding a predetermined gap between the blocks;

a second spring means between the inner block and base member surrounding the shaft and having a spring pressure for urging the inner block and base apart, the second spring means having a spring pressure which is smaller than the spring pressure of the first spring means.

Thus when the outer block is released, the gap between the inner and outer blocks widens to the predetermined gap by the coaction of the first spring means between the inner and outer blocks loosening the leg member therebetween, and a gap between the base and inner block is subsequently created by the coaction of the second spring means between the inner block and base to permit rotation of the leg holding member on the base and disengagement of the first and second positioning members.

BRIEF DESCRIPTION OF THE DRAWINGS

The foregoing and other objects and advantages will appear more fully hereinafter from a consideration of the detailed description which follows, taken together with the accompanying drawings, wherein a single embodiment of the invention is illustrated by way of example. It is to be expressly understood, however, that the drawings are for illustration purposes and are not to be construed as defining the limits of the invention.

DETAILED DESCRIPTION OF THE INVENTION

Figure 1:
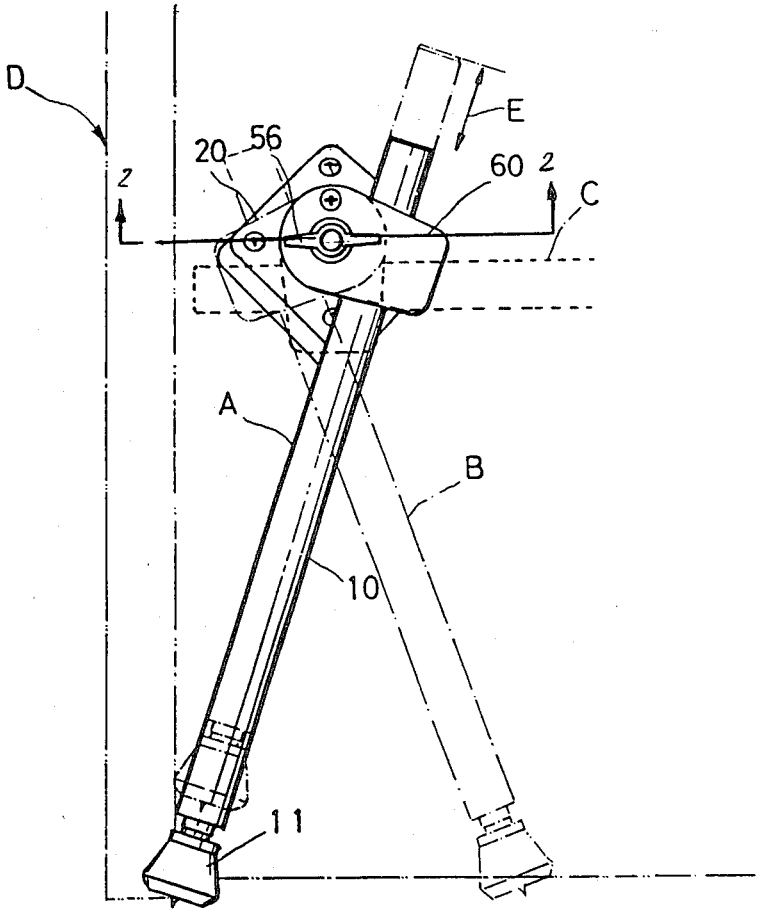
FIG. 1 is front view of a leg support structure according to this invention.

As shown in FIG. 1, the support leg structure according to this invention comprises a support leg member 10. The leg member 10 is installed under the trunk part of the bass drum D. The leg member 10 is held at a certain incline on either the right side or the left side of the drum, as indicated in FIG. 1 by the solid line position A or the dotted line position B. At the time of carrying the drum, it is held freely rotatably so as to be accommodated in parallel with the trunk portion of the drum. This is shown by the broken line position C in the FIG. 1. At the same time, the length of the leg is held in a freely expandable or contractable manner so that, if necessary, the length of the leg itself may be changed in the direction indicated by the arrow marked E.

The support leg structure according to this invention comprises the leg 10, base 20, rotary shaft 30 and the leg-holding member 60. The leg-holding member 60 further comprises an inner block 40 and outer block 50.

The leg 10 is preferably an elongated bar-shaped member having a certain fixed length. A leg tip 11 is provided which is made, typically, of rubber. Leg 10 does not require any special structure as long as it can appropriately extend or contract.

Figure 2:
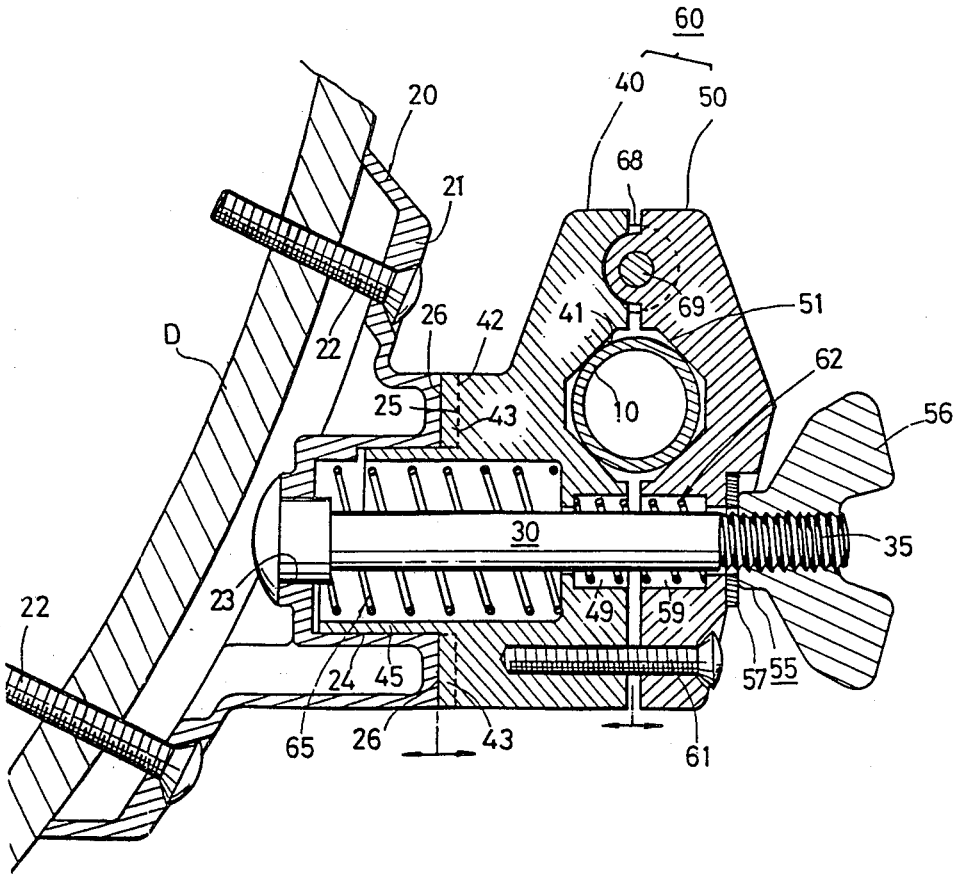
FIG. 2 is an enlarged cross-section of the support structure of this invention taken along lines 2—2 of FIG. 1.

As shown in FIG. 2, the base 20 has a dish-shaped main body 21 and has an attachment mean for attaching it to the main drum body consisting of a plurality of threaded bolts engaging the main drum body. On the upper surface of the base 20 is a circular-shaped surface 25, as shown more clearly in FIG. 3. Formed therein are prescribed radial positioning grooves (26A, 26B and 26C).

The positioning grooves, 26A, 26B and 26C are disposed to provide the three holding positions A, B, and C, respectively, for leg 10, as described earlier in conjunction with FIG. 1.

Figure 3:
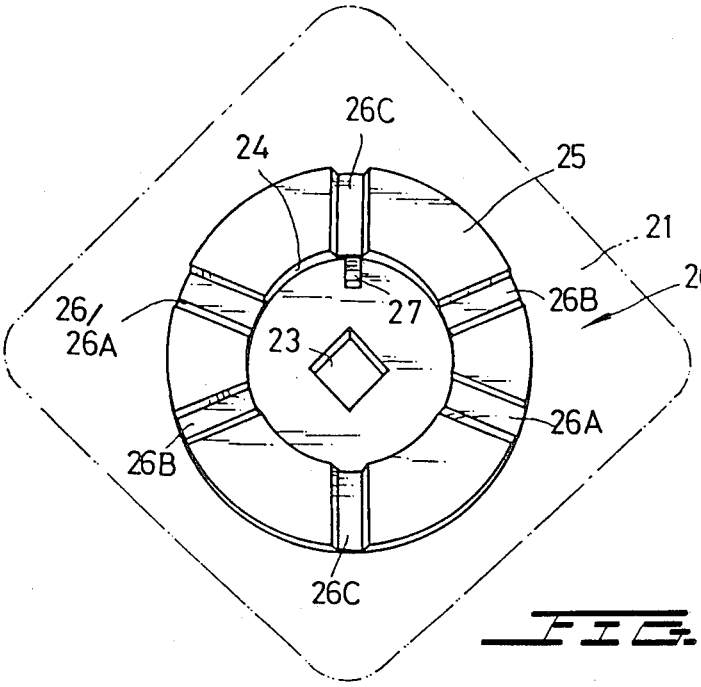
FIG. 3 is a perspective view showing the circular surface of the base.

Referring to FIGS. 2 and 3, a hole 23 is provided for the setting of rotary shaft 30. A sliding tube 24 is provided in the base member for the insertion and holding of the inner block 40 so that it is freely rotatable therein. Convex stopper 27 is provided for the controlling of the rotational range thereof.

The rotary shaft 30 projects from hole 23, which is provided at the center of base 20. The shaft 30 passes through leg-holding member 60, with the end thereof being thread 35.

The leg-holding member 60 is constructed of an inner block 40 and outer block 50, which can be freely opened or closed and which have mutually facing leg-holding parts 41 and 51 for the purpose of holding the leg 10. This is shown in cross section in FIG. 2.

Figure 4:
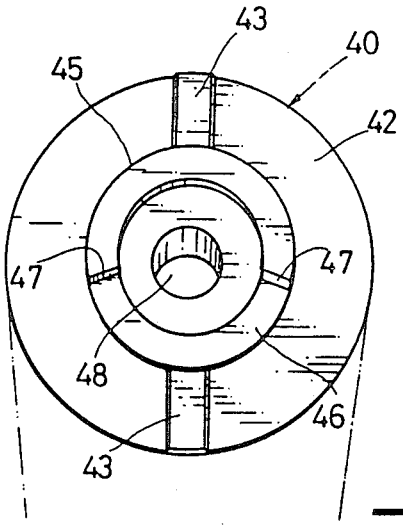
FIG. 4 is a perspective view showing the mating circular surface on the inner block holding the leg member.

Referring to FIGS. 2 and 4, in the leg-holding member 60 on inner block 50 there is formed a circular mating surface 42 having thereon a radially protuberant stripe 43. This surface 42 is constructed to slidingly mate with surface 25 on base 20. The protuberant stripe 43 is also constructed to matingly insert into radial positioning groove 26 which has been provided on the circular surface 25 of the base 20, upon rotation of surface 42, i.e. rotation of leg-holding member 60.

Tubular member 45 is slidably inserted into base 20. Tubular member 45 encloses therein spring 65. The end of member 45 has thereon a portion removed therefrom 46 for the purpose of limiting rotational range of the leg-holding member 60 by contact of stop surface 47 with stop means 27 which protrudes inside sliding tube 24 of base 20. An insertion hole 48 is provided for rotary shaft 30.

Referring to FIG. 2, on the upper surface of block 50 constituting the upper surface of the leg-holding member 60, there is formed a tightening means 55, which is equipped with tightening nut 56 threadedly engaging thread 35 of shaft 30 that runs through the leg-holding member 60. A metal washer 57 may be provided.

The inner block 40 and outer block 50 that constitute the leg-holding member 60, are constructed in such a manner so as to freely close or open. This is accomplished by having rotary shaft 30 run through openings 49 and 59 in blocks 40 and 50, respectively. Between inner block 40 and the outer block 50, is a another spring means 62 wound around rotary shaft 30 urging blocks 40 and 50 apart to open the gap therebetween by loosening tightening means 55, 56. In addition, there is provided a stopper pin 61 between the two blocks 40 and 50. The purpose of the stopper pin 61 is to control the separation between the two blocks and the distance therebetween.

The opening between blocks 40 and 50 is such as to release the holding of leg 10, by leg-holding parts 41 and 51 against which leg 10 is contact therewith, by maintaining a separation range between approximately 0.5 and one millimeter.

The stopper pin 61 is a threaded screw which can freely carry out the required adjustment of the opening between the blocks and can be freely removed therefrom.

Referring to FIG. 2, hinge 68 and axial pin 69 are provided. By using such a hinge structure opposite the stopper pin 61, the structure can smoothly open and close.

Moreover, the leg-holding member 60 is elastically or springedly held to the base 20 due to the rotation of the said leg-holding part. Referring to FIG. 2, there exists a second spring 65 which is wound or placed around rotary shaft 30 between the inner block 40 of the leg-holding member 60 and the base 20 urging them apart, so that a gap between the leg-holding member 60 and the base 20 will open up.

It is important herein, that the spring pressure of second spring 65 is smaller than the spring pressure of first spring 62 installed between the inner block 40 and outer block 50. In the embodiment and position depicted, the spring pressure of the first spring 62 at the time of its installation is three kilograms and the spring pressure of the second spring 65 at the time of its installation is 1.5 kilograms.

Referring to FIG. 2, if the first spring 62, whose spring pressure is large, and the second spring 65, whose spring pressure is small are springedly insert around common rotary shaft 30 as described above, upon loosening tightening screw means 56 at the tip of the rotary shaft 30, the first spring 62 (whose spring pressure is greater) extends with the result that the gap between the inner block 40 and outer block 50 is opened. However, pin 61 between inner block 40 and outer block 50, restricts the elongation of the first spring 62 to a predetermined length. Beyond that range, second spring 65 begins to activate to thereby open the gap between leg-holding member 60 and base 20. Thus, upon the loosening of tightening means 56, the gap between inner and outer blocks 40 and 50 opens loosening leg 10. This is followed sequentially by the opening of the gap between the base 20 and the leg-holding member 60.

Figure 5:
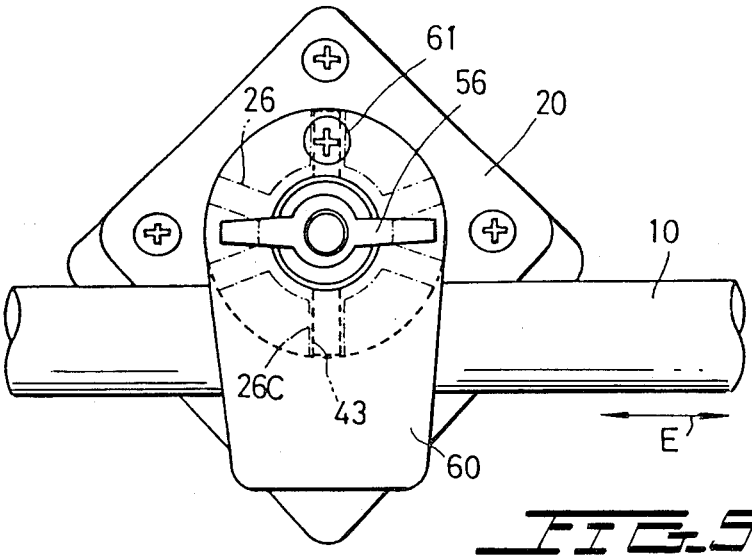
FIG. 5 is an expanded front view of the leg-holding member.
Figure 6:
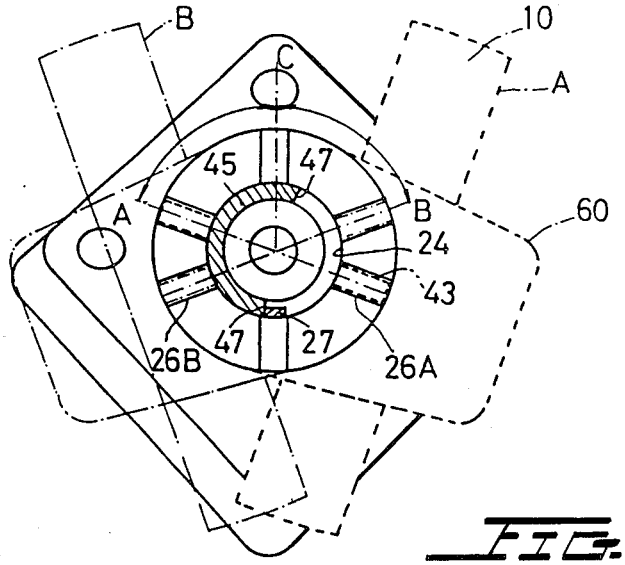
FIG. 6 is a cross-section showing a state of engagement between the inner block and the base circular surface.

Referring to FIGS. 2, 5 and 6 herein the rotation as well as elongation and contraction of the leg 10 are carried out by the operation of the tightening means 56. If the tightening means 56 is loosened, the gap between the inner and outer blocks 40 and 50 which have the first spring 62 therebetween with a greater spring pressure is opened and leg 10, which was held by mutually facing leg-holding surfaces 41 and 51, is released, with a result that it becomes possible for the leg 10 to move in the direction indicated by the arrow marked E (FIG. 5). Subsequent to the restriction on the gap between both blocks by stopper pin 61, the gap between the inner block 40 and base 20 is opened by the urging of second spring 65, permitting leg-holding member 60 to be rotated to a prescribed position.

In connection with the rotation of the leg-holding member 60, the operation can be carried quite efficiently by the engagement between the positioning stripe radial grooves 26 (26A, 26B and 26C) which are provided on the circular surface 25 of base 20 and protuberant radial stripe 43 which has been provided on the circular mating surface 42 on inner block 40.

Referring to FIG. 6 and FIG. 1, the engagement positions A and B are the right-side and left-side positions for the support of the drum by leg 10. The engagement position shown in FIG. 5 (or C) is the accommodation position for the holding of leg 10 parallel with the trunk portion of the drum.

After the holding position or leg 10 is determined, i.e., A or B, the length of leg 10 is determined, i.e. C, the tightening means is then tightened thereby effecting fixation thereof.

Referring to FIG. 6, upon rotation of leg holding member 60, the convex stopper means 27 provided on base 20 and stopping surface 47 on the tubular portions of the inner block 40 engage each other to thereby control the rotational position of the leg-holding block 60.

Accordingly, the support-leg structure of this invention provides for the rotation of the leg to a prescribed holding position and the expansion or contraction of the leg relative to the floor surface by means of an extremely simple and concise structure, by the tightening of a single member and, moreover, the said operation can be achieved by a single maneuver. Thus, this invention has a number of advantages over those known in the art, including the reduction of the number of the parts required, the reduction of both trouble and cost involved, ease of assembly, efficiency in use and the satisfactory feeling obtained by the user.

What is claimed is:

1. A support leg for a bass drum having a supporting bass drum body, the support leg comprising:

an elongated leg member;

a base member having an attachment means for attaching the base member to the drum body; and a circular surface on the base member having a first positioning member thereon;

a shaft means projecting from the center of the circular surface, one end of which is attached to the base member, a leg holding member comprising:

inner and outer block members surrounding the shaft having mutually facing surfaces for holding the leg member, the inner block having a mating circular surface which slidably mates with the circular surface of the base member and a second positioning member which mates with and engages the first positioning member;

means, mounted to the other end of the shaft, for releasably engaging the outer block and urging the blocks together;

a first spring means between the blocks surrounding the shaft and having a spring pressure for urging the blocks apart;

a member connecting the blocks for setting and holding predetermined gap between the blocks;

a second spring means between the inner block and base member surrounding the shaft and having a spring pressure for urging the inner block and base apart, the second spring means having a spring pressure which is smaller than the spring pressure of the first spring means;

wherein when the outer block is released, the gap between the inner and outer blocks widens to the predetermined gap by the coaction of the first spring means between the inner and outer blocks loosening the leg member therebetween, and a gap between the base and inner block is subsequently created by the coaction of the second spring means between the inner block and base to permit rotation of the leg holding member on the base and disengagement of the first and second positioning members.

2. The support leg of claim 1, further comprising a pivot means, opposite the connecting member, for connecting the blocks and permitting them to pivot open and close.

3. The support leg of claim 1 wherein the positioning members are radial.

4. A support leg for a bass drum having a supporting bass drum body, the support leg comprising:

an elongated leg member;

a base member having an attachment means for attaching the base member to the drum body; and a circular surface on the base member having a positioning groove thereon;

a shaft means projecting from the center of the circular surface, one end of which is attached to the base member, the other end of which is threaded;

a leg holding member comprising:

inner and outer block members surrounding the shaft having mutually facing surfaces for holding the leg member, the inner block having a mating circular surface which slidably mates with the circular surface of the base member and a projecting strip which mates with and engages the positioning groove;

a tightening member threadedly engaging the other end of the shaft and engaging the outer block;

a first spring means between the blocks surrounding the shaft and having a spring pressure for urging the blocks apart;

a threaded member threadedly connecting the blocks for setting a predetermined gap between the blocks;

a second spring means between the inner block and base member surrounding the shaft and having a spring pressure for urging the inner block and base apart, the second spring means having a spring pressure which is smaller than the spring pressure of the first spring means;

wherein when the tightening means is loosened, the gap between the inner and outer blocks widens to the predetermined gap by the coaction of the first spring means between the inner and outer blocks loosening the leg member therebetween and a gap between the base and inner block is subsequently created by the coaction of the second spring means between the inner block and base to permit rotation of the leg holding member on the base and disengagement of the projecting strip from the positioning groove.

5. The support leg of claim 4, wherein the positioning groove is radial.

6. The support leg of claim 4, further comprising a hinge member, opposite the threaded member for connecting the blocks and permitting them to pivot open and close.

* * * * *